US006406821B1

(12) United States Patent
Ichikawa et al.

(10) Patent No.: US 6,406,821 B1
(45) Date of Patent: Jun. 18, 2002

(54) METHOD FOR PREPARING SILVER HALIDE EMULSIONS AND APPARATUS FOR IMPLEMENTING THE METHOD

(75) Inventors: Yasunori Ichikawa; Hideharu Nagasawa; Tetsuo Nomiyama, all of Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/684,834

(22) Filed: Oct. 10, 2000

(30) Foreign Application Priority Data

Oct. 7, 1999 (JP) ..... 11-287379

(51) Int. Cl.[7] ..... G03C 1/015
(52) U.S. Cl. ..... 430/30; 430/569
(58) Field of Search ..... 430/30, 569

(56) References Cited

U.S. PATENT DOCUMENTS

| | | | | |
|---|---|---|---|---|
| 3,692,283 A | | 9/1972 | Sauer et al. | 259/24 |
| 3,782,954 A | | 1/1974 | Porter et al. | 96/94 |
| 4,026,668 A | | 5/1977 | Culhane et al. | 23/253 A |
| 4,251,627 A | * | 2/1981 | Calamur | 430/569 |
| 4,933,870 A | | 6/1990 | Chang | 364/497 |
| 5,166,015 A | * | 11/1992 | Ichikawa et al. | 430/569 |
| 5,248,577 A | | 9/1993 | Jerome | 430/30 |
| 5,317,521 A | | 5/1994 | Lin et al. | 364/496 |
| 5,339,875 A | * | 8/1994 | English et al. | 430/569 |
| 5,753,515 A | * | 5/1998 | Benzing et al. | 430/569 |

FOREIGN PATENT DOCUMENTS

| | | | |
|---|---|---|---|
| JP | 51-138282 | 11/1976 | G05B/11/36 |
| JP | 53-41114 | 10/1978 | B01J/13/00 |
| JP | 55-10545 | 3/1980 | C01G/5/02 |
| JP | 58-58288 | 12/1983 | C01G/5/02 |
| JP | 61-31454 | 7/1986 | G03C/1/02 |
| JP | 62-182623 | 8/1987 | G01F/11/04 |
| JP | 2-67952 | 3/1990 | G01N/27/26 |
| JP | 5-232611 | 9/1993 | G03C/1/015 |
| JP | 8-146543 | 6/1996 | G03C/1/015 |

OTHER PUBLICATIONS

Patent Abstracts of Japan vol. 1997, No. 10, Oct. 31, 1997 & JP 09 146197 A (Fuji Photo Film Co Ltd), Jun. 6, 1997 *abstract*.

Patent Abstracts of Japan vol. 014, No. 439 (C–0761), Sep. 19, 1990 & JP 02 172815 A (Fuji Photo Film Co Ltd), Jul. 4, 1990 *abstract*.

* cited by examiner

*Primary Examiner*—Richard L. Schilling
(74) *Attorney, Agent, or Firm*—Sughrue Mion, PLLC

(57) ABSTRACT

A method and an apparatus for precisely controlling flow rate of reactant solution such as silver nitrate solution or halide salt solution which is added into a precipitation vessel. The method comprises applying a pressure to each source of said two solutions and controlling both said applied pressure and a flow resistance of each feed lines of said two solutions so that each flow rate of the two solutions to be added into the precipitation vessel can be adjusted to a predetermined value. The apparatus comprises a storage vessel for the reactant, a feed line to feed the reactant into the precipitation vessel and a flow rate controller, wherein the storage vessel is connected to a pressure controller which includes a pressure vessel pressurized with air or other gases and a pressure control valve, the feed line has a pressure sensor for detecting a pressure inside the feed line, a flow meter and a flow path opening controller along its line in order, the flow rate controller controls the flow rate of the reactant fed into the precipitation vessel by controlling the pressure control valve and the flow path opening controller.

5 Claims, 2 Drawing Sheets

METHOD FOR PREPARING SILVER HALIDE EMULSIONS AND APPARATUS FOR IMPLEMENTING THE METHOD

FIELD OF THE INVENTION

A silver halide emulsion, particularly for feeding an aqueous silver nitrate solution and an aqueous halide solution with high accuracy into an aqueous protective colloidal solution in a precipitation vessel for preparing silver halide crystals.

BACKGROUND OF THE INVENTION

The most important process in manufacturing a photographic emulsion is the one to form silver halide crystals. Precisely controlled size and amount (its distribution) of the silver halide crystals are main factors to give a good quality to the photographic emulsion, which leads to an improvement of photographic materials.

One of conventional way to form silver halide crystals was that an aqueous silver nitrate solution is added into a precipitation vessel containing the mixed solution of the aqueous halide salt solution and an aqueous protective colloidal solution. The ways of adding the aqueous silver nitrate solution are, for examples, to use a pressure head formed between a level of the aqueous silver nitrate solution (higher position) and that of the mixed solution in the precipitation vessel (lower position), and to use pump. To control a flow rate for addition, an orifice is put in its feed line or pump is just controlled to control its discharging amount. However this way not only does not give accurate control of flow rate but is not enough to control a structure of crystal of silver halide.

U.S. Pat. No. 3,782,954, Japanese Patent Publication 41114/78 (tokko-sho 53-41114) and Japanese Patent Publication 58288/83(tokko-sho 58-58288) show the method that an aqueous silver nitrate solution and an aqueous halide salt solution are fed into a mixer installed in a precipitation vessel to obtain an improved uniformity in size of silver halide crystal grains In Japanese Laid-open Patent 138282/76 (tokkai-sho 51-138282), U.S. Pat. No. 4,026,668, Japanese Patent Publication 31454/86 (tokko-sho 61-31454), Japanese Laid-open Patent 67952/90 (tokkai-hei2-67952), U.S. Pat. No. 5,248,577 and Japanese Laid-open Patent 232611/93 (tokkai-hei 5-232611), another method is shown in which flow rates of an aqueous silver nitrate solution and an aqueous halide salt solution are controlled to keep an electric potential of a mixed solution reacting in a precipitation vessel being a predetermined value. This method could control a size of each silver halide crystal grain.

In most of the above described methods, pumps are used for feeding and adding an aqueous silver nitrate solution and an aqueous halide salt solution from their storage vessels to a precipitation vessel because those pumps have a good controllability and a good responsibility, and a lot of selections to meet user's purpose. The pumps, however, generally have a narrow range of flow rate with high accuracy, which requires to use a plurality of pumps each of which have a different range of flow rate to cover a desired whole range of flow rate.

As mentioned above, the most important process in manufacturing a photographic emulsion is the one to form silver halide crystals.

Precisely controlled size and amount (its distribution) of the silver halide crystals are main factors to give a good quality to the photographic emulsion, which leads to an improvement of photographic materials. To obtain such silver halide emulsion, it is necessary to control the flow rate of those solutions added into the precipitation vessel with high accuracy to meet the rate required at the initial stage and at the terminal stage of adding the solutions according to a predetermined program and at the steady state according to a required flow rate at every moment, and to control precisely the total amount of the solution added To avoid a waste of the solution which are expensive, it is desirable to consume whole the solution once prepared without leaving any of the solution or to make the feed line available in common to forming any types of a great number of emulsions. For example, at least basic nine types of emulsion are required to make color negatives, such as emulsion for blue-sensitive layer, green sensitive layer and red sensitive layer, each of which are divided to three emulsion layers, high sensitive layer, medium sensitive layer and low sensitive layer. Furthermore taking a variety of photographic speed of emulsion into consideration, the number of the types of emulsion increases a lot. To cope with manufacturing that great number of emulsion types, the aqueous silver nitrate solution and the aqueous halide salt solution have to be fed according to a variety of flow rates each prescription of emulsions required respectively. To cope with the situation by only one facility to feed the solutions, it has to have a wide range controllability in flow rate within which high accurate control is kept, for example, the ratio between the minimum flow rate and the maximum flow rate should be 1 to 10, preferably 1 to 20 or more. Laid-open Patent 146543/96 (tokkai-hei 8-146543) shows the method that can avoid not only above mentioned shortcomings of the prior arts but also another faults that the feed line using pump system always leaves some amount of the solution inside the feed line as a waste. However the method using pump cannot completely avoid a leakage from its sealing mechanism, such as mechanical seal, grand seal and lip seal, therefore it needs frequent maintenance specially with respect to its sealing, which would be a troublesome operation because an aqueous silver nitrate solution does harm to a skin of human. Laid-open Patent 182623/87 (tokkai-sho 62-182623) shows the method using a principle of injection syringe in which a flow rate range is easily controlled by selecting a cylinder with a different bore size. In this method accuracy of flow rate fed from the cylinder depends on machining the cylinder bore to extremely close tolerances. If the volume of the cylinders are the same, the smaller bore cylinder has generally a better accuracy but it leads to a longer cylinder which is practically undesirable.

SUMMARY OF THE INVENTION

An object of the present invention is to provide a method of preparing silver halide emulsion and an apparatus there for which are capable of controlling of flow rate of solutions added in to a precipitation vessel with high accuracy over a wide range of the flow rate without using pump or cylinder systems.

According to present invention, a method for preparing silver halide emulsion by reacting an aqueous silver nitrate solution with an aqueous halide salt solution in a colloidal solution contained in a precipitation vessel comprising the steps of applying a pressure to each source of said two aqueous solutions; controlling said applied pressure and flow-resistance of each feed lines of said two aqueous solutions so that each flow rate of the two aqueous solutions to be added into the colloidal solution can be controlled.

In this method, it is preferable to control the flow-resistance in feed lines by controlling flow-path opening in the feed lines. The flow path opening is preferably controlled by a control valve varying a cross-sectional area of flow path and an actuator to actuate said control valve which are installed in said feed line. The applied pressure and the flow-resistance are preferably controlled according to a value of electric potential measured with respect to a mixed solution reacting in the precipitation vessel.

According to another aspect of the present invention, an apparatus for preparing silver halide emulsion by reacting an aqueous silver nitrate solution with an aqueous halide salt solution in a colloidal solution contained in a precipitation vessel, comprising:

- a first vessel for containing an aqueous silver nitrate solution;
- a second vessel for containing an aqueous halide salt solution;
- a pressure controller for controlling a pressure inside the first vessel and the second vessel;
- a pressure sensor installed in the vessels respectively for measuring each pressure inside the vessels to generate a signal indicating said each pressure;
- a first feed line for feeding the aqueous silver nitrate solution contained in the first vessel into the precipitation vessel;
- a second feed line for feeding the aqueous halide salt solution contained in the second vessel into the precipitation vessel;
- a first flow meter installed in the vessels for measuring a flow rate of the aqueous silver nitrate solution;
- to generate a signal indicating said flow rate;
- a second flow meter installed in the vessels for measuring a flow rate of the aqueous halide salt solution to generate a signal indicating said flow rate;
- a first flow path opening controller disposed in the first feed line;
- a second flow path opening controller disposed in the first feed line; and
- a flow rate controller for controlling said pressure controller to adjust said pressure and for controlling said flow path opening controller to adjust said flow path opening based on a transmitted pressure value signal from said pressure sensor and a transmitted flow rate value signal from said flow meter so that a predetermined flow rate can be obtained.

In this apparatus, it is preferable to use a control valve varying a cross-sectional area of flow path and an actuator to actuate said control valve as the flow-path opening controller installed in said feed lines. Preferable control valve is, for example, one having a conical or spindle-shaped valve head with a flange to sit on a valve seat, the valve head is controllably moved by an actuator mounted on the upper portion of the valve. The predetermined flow rate is preferably determined according to a value of electric potential of the mixed solution reacting each other in the precipitation vessel measured by an electric potential detector put in the mixed solution.

DETAILED DESCRIPTION OF THE INVENTION

Figure 1:
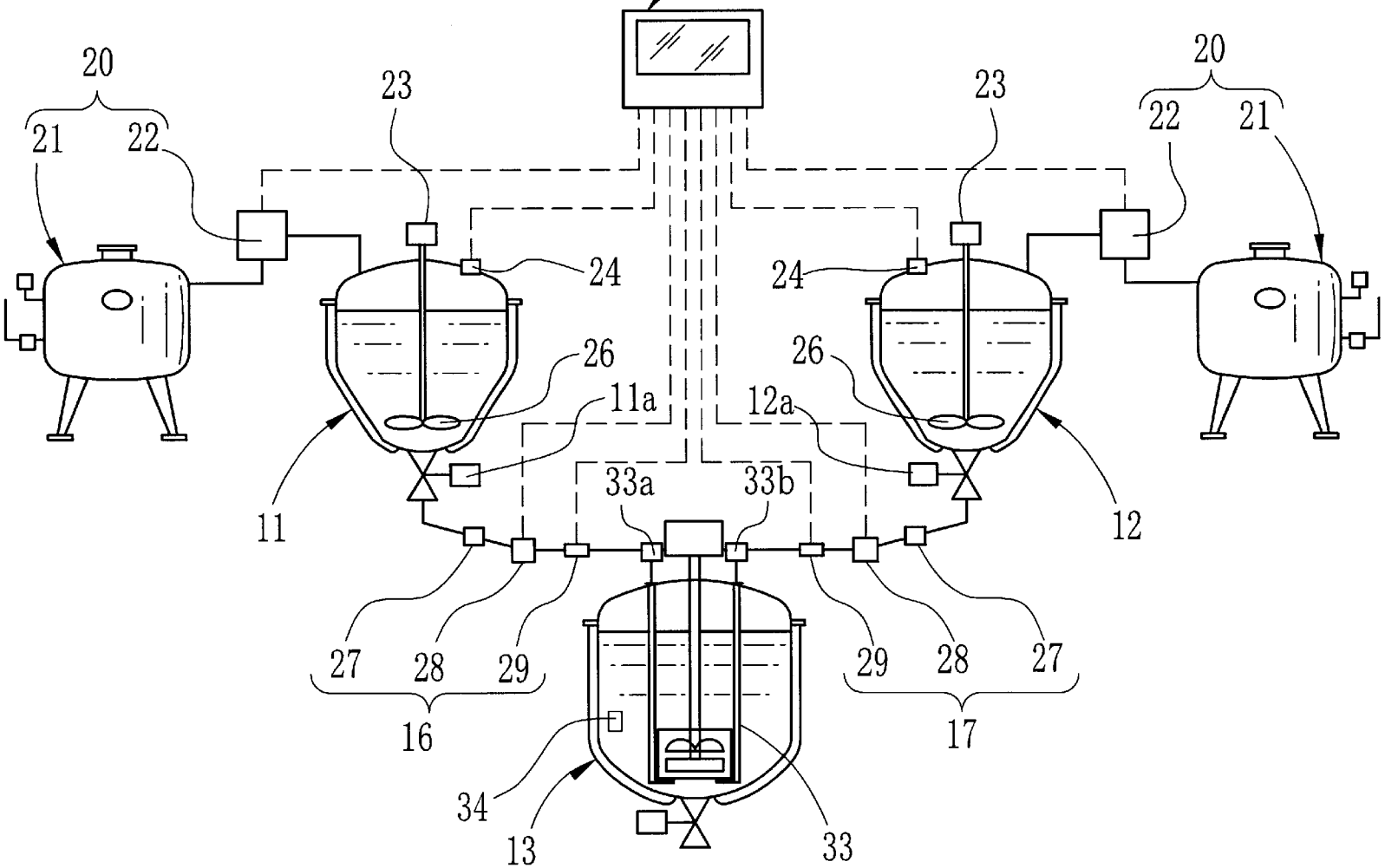
FIG. 1 shows a schematic diagram illustrating method and apparatus for preparing silver halide emulsion of the present invention.

As illustrated ion FIG. 1, an apparatus for preparing silver halide emulsion of the invention includes a first vessel 11 for containing an aqueous silver nitrate solution (a silver nitrate solution storage vessel 11), a second vessel 12 for containing an aqueous halide salt solution (a halide salt solution storage vessel 12), a precipitation vessel 13 where those two solutions are added to form a silver halide emulsion, a first feed line 16 for feeding the aqueous silver nitrate solution contained in the first vessel into the precipitation vessel, a second feed line 17 for feeding the aqueous halide salt solution contained in the second vessel into the precipitation vessel and a flow rate controller 31.

An agitator 33 is installed in the precipitation vessel 13 containing a colloidal solution to agitate a mixture of solutions.

A pressure controller 20 includes a pressure vessel 21 pressurized with air or other gases and a pressure control valve 22. The pressure vessel 21 is connected to a silver nitrate solution storage vessel 11 via the pressure control valve so that a pressure in the storage vessel 11 is adjusted to a predetermined level by controlling a opening of the pressure control valve 22.

An agitator 23 and a pressure sensor 24 are installed in the silver nitrate solution storage vessel 11.

A feed line pressure sensor 27 for detecting a pressure inside the feed line, a flow meter 28 and a flow path opening controller 29 are disposed along the first feed line 16 for feeding the aqueous silver nitrate solution in order in the direction from the storage vessel 11 to the precipitation vessel 13. Likewise, a halide salt storage vessel 12 has a pressure controller 20, an agitator 23 and a pressure sensor 24 installed therein, and a feed line pressure sensor 27 for detecting a pressure inside the feed line, a flow meter 28 and a flow path opening controller 29 are disposed along the halide salt solution feed line 17 in order.

As for pressure controllers currently available, some of them have a quick response to adjust the pressure and some others have a slow response. In the use of the quick response controller, it is possible to start pressuring on starting feeding and adding a solution, in the use of the slow one, it is possible to start pressuring to reach a predetermined level before starting feeding and adding the solution.

As for flow meters, electromagnetic flow meter, mass flow meter, ultrasonic flow meter and oval flow meter are available, for example, which are capable of making high accuracy measurement and real time transmission of a signal representing the measured value.

A pressure measured by the pressure sensor 24 and a flow rate by the flow meter are converted into signals which are transmitted to the flow rate controller 31. The flow rate controller 31 calculates appropriate values of the pressures of the silver nitrate storage vessel 11 and the halide salt storage vessel 12 and the flowpath openings in the feed lines 16 and 17 according to the measured values of the pressure and the flow rate so that the flow rates of the feed lines 16 and 17 can be adjusted to a predetermined values, and then transmits signals of the calculated values to the pressure controller 20 and the flow path opening controller 29.

The pressure controller 20 controls the pressure control valve 22 to make the pressures of the silver nitrate solution storage vessel 11 and the halide salt solution storage vessel 12 be adjusted to the values of the transmitted signals. Likewise the flow path opening controller 29 controls the flow path opening of the feed line 16 and 17 to be adjusted to the values of the transmitted signals .

Figure 2:
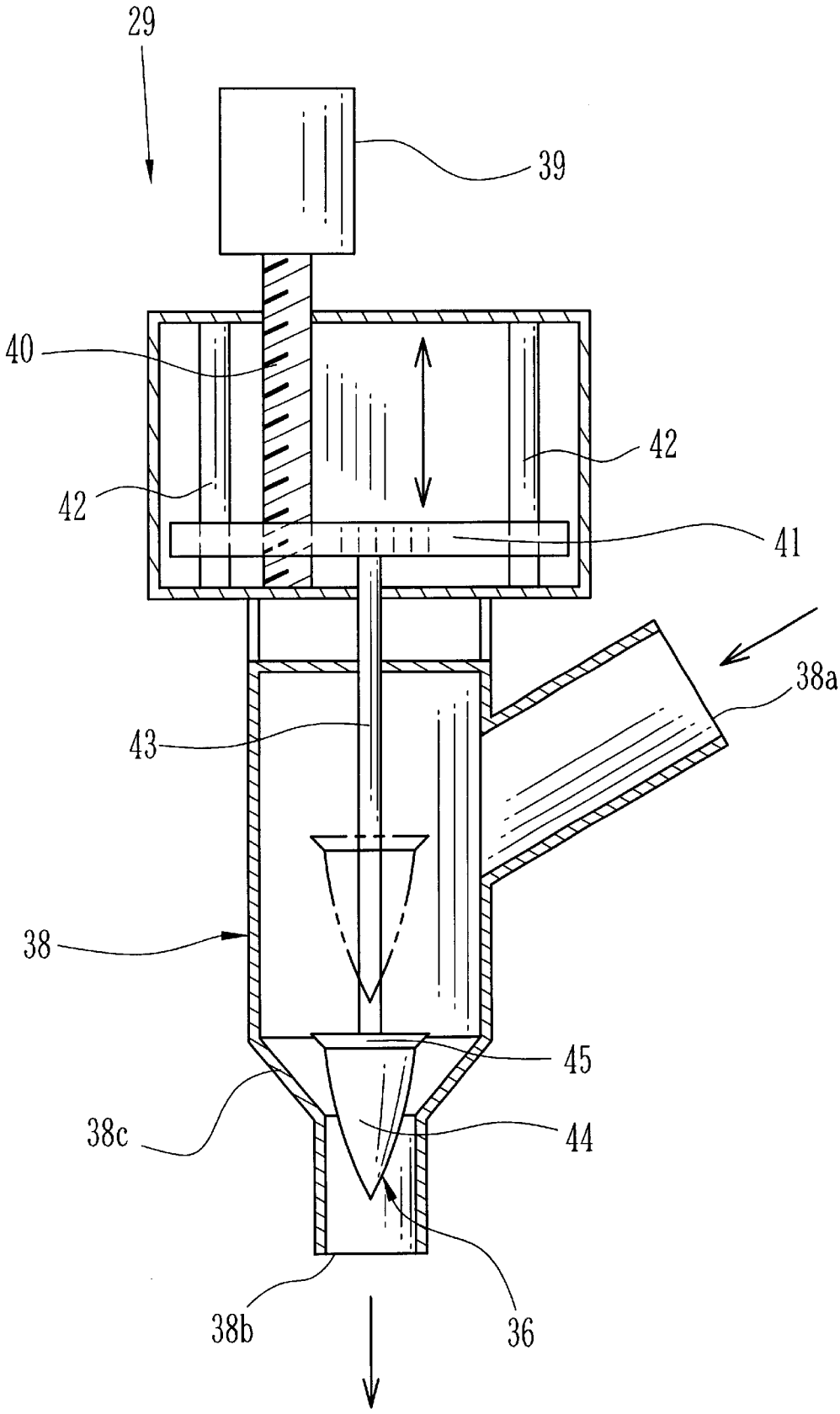
FIG. 2 is a fragmentary cross sectional view showing a flow path opening controller.

As for the flow path opening controller 29, a motor-controlled type control valve as shown in FIG. 2 is preferably available. The flow-path opening controller 29 of this type comprises a control valve 36, a valve box 38, a servo motor 39, a lead screw 40, a moving member 41 and guide shaft 42. The servo motor 39 is driven by the signal from the flow rate controller 31 to rotate the lead screw 40. Rotation of the lead screw 40 moves the moving member 41 up and down along the guide shaft 42. The control valve 36 is connected to the moving member 41 by a valve shaft 43. Thus the control valve 36 moves up and down as the servo motor 39 rotates the lead screw 40. The control valve 36 includes a conical or a spindle-shaped valve head 44 and a valve flange 45 to sit on a valve seat.

The valve box 38 has a valve inlet 38*a* and a valve outlet 38*b* which are connected to the feed line respectively. Liquid flows in the valve box through the valve inlet and flow out from the valve outlet. As the control valve 36 goes up, flow rate in the valve box 38 increases, and as the control valve goes down, the flow rate decreases. When the control valve is closed, the valve flange 45 sit on a valve seat 38*c* tightly to block the liquid flow. Such motor-controlled type control valve is disclosed in Japanese Laid-open patent 35090/89 (tokkai-sho 64-35090).

EXAMPLE

As a test system of the invention, a precipitation vessel 13 of 700 l in volume and two 150 l storage vessels 11, 12 for containing the silver nitrate solution and the halide salt solution respectively both of which were located 3 meters above the precipitation vessel were used. An agitator 33 disclosed in Japanese Patent Publication 10545/80 (tokko-sho 55-10545) was installed in the precipitation vessel 13. The feed line 16 was connected to one of connecting ports 33*a* and the feed line 17 was connected to the other connecting port 33*b*. Some electromagnetic flow meters made by Yokogawa Electric Corporation was selected as a flow meter 28 to be able to measure a wide range flow rate with high accuracy, with changing the size of conduit connected thereto in need.

Limitation of possible flow rate range where high accuracy control of flow rate can be kept was tested using the test system mentioned above with respect to both silver nitrate solution line and halide salt solution line. The silver nitrate solution storage vessel 11 and the halide salt solution storage vessel 12 were filled with 150 l water respectively. Pressures of 49 kPa were applied to both the vessel 11 and the vessel 12 by adjusting an opening of the pressure control valve 22. Under the conditions, degree of flow path opening of the flow path opening controller 29 was measured when the flow meter 28 indicated 1 l/min. This degree of flow path opening of the flow path opening controller 29 was referred to as standard opening at 49 kPa and 1 l/min.

The degree of flow path opening of the controller 29 was initially set at the standard opening at 49 kPa and 1 l/min. Pressure of 49 kPa was applied to the two vessels 11 and 12 and the agitator 33 was started to rotate at 1000 rpm. Bottom stopping valves 11*a* and 12*a* of the vessels 11 and 12 were opened and feeding solutions into the precipitation vessel 13 under the control was started. Measured flow rate at every moment by the flow meter 28 in the process and 1 l/min flow rate at the standard opening at 49 kPa and 1 l/min were compared. The difference between them (flow rate fluctuations)was within ±0.50% with respect to the silver nitrate solution feed line 16 and within ±0.51% with respect to the halide salt solution feed line 17.

It proves the test system has a good controllability on the flow rate with high accuracy.

Another increased standard opening at the same pressure value and newly increased flow rate were given by increasing the degree of flow path. Under this new condition, measured flow rate at every moment by the flow meter 28 in the process and the newly increased flow rate were compared. Likewise such comparison were made one after the other at further increased standard opening. Finally the flow rate leveled off in spite of increasing the degree of flow path opening because of flow resistance of feed line 16 or 17. This final flow rate was 38 l/min and flow rate fluctuations there at was within ±0. 61% with respect to the silver nitrate solution feed line 16 and within ±0.65% with respect to the halide salt solution feed line 17. At the flow rate of 38 l/min, the system still have a good controllability with high accuracy.

To know the upper limit of the flow rate to be controlled sufficiently, higher pressure was applied while the degree of the flow path opening of the controller 29 was fixed so that the flow path opening is equivalent to a half of cross sectional area of conduit constituting feed line 16 or 17. As a result maximum flow rate where the flow rate fluctuations was still within ±1% was 54 l/min at the pressure of 215.6 kPa.

Likewise, higher pressure was applied while the flow path opening of the controller 29 was fully opened. As a result maximum flow rate where the flow rate fluctuations was still within ±1% was 48 l/min at the pressure of 215.6 kPa. Result of using water instead of the silver nitrate solution or the halide salt solution was almost the same.

In summary, it is proved that the apparatus for preparing a silver halide emulsion of the present invention can control the flow rates of silver nitrate solution and halide salt solution over a wide range such as 1 to 48 since minimum flow rate to be sufficiently controlled was 1 l/min and maximum was 48 l/min. In the example described, the system of the apparatus controls flow rates according to the flow rates programmed in the flow rate controller. However the flow rates can be also controlled according to a electric potential of the mixed solution measured by a potentiometer 34 in the precipitation vessel 13 to keep the electric potential at a predetermined value as shown in Japanese Laid-open Patent 138282/76 (tokkai-sho 51-138282), U.S. Pat. No. 4,026,668, Japanese Patent Publication 31454/86 (tokko-sho 61-31454), Japanese Laid-open Patent 67952/90 (tokkai-hei2-67952), U.S. Pat. No. 5,248,577 and Japanese Laid-open Patent 232611/93 (tokkai-hei 5-232611). In this case, signal of measured electric potential is transmitted to the flow rate controller 31. The flow rate controller 31 calculates appropriate values of the pressures of the silver nitrate storage vessel 11 and the halide salt storage vessel 12 and the flow-path openings in the feed lines 16 and 17 according to the measured values of the pressure and the flow rate so that the electric potential can be adjusted to a predetermined values, and then transmits signals of the calculated values to the pressure controller 20 and the flow path opening controller 29.

According to the present inventions, it is possible to provide a method of preparing silver halide emulsion and an apparatus there for which are capable of controlling of flow rate of an aqueous silver nitrate solution and an aqueous halide salt solution to be added into a precipitation vessel with high accuracy yet over a wide range of the flow rate, without using pump or cylinder systems, only by controlling pressures applied to the solutions and flow path openings of the feed lines for the solutions. This means one apparatus system can cope with manufacturing various types of emulsion each of which requires a different flow rate program than others over a wide range, and no need of maintenance of seals in the case of using pump.

What is claimed is:

1. A method for preparing silver halide emulsion by reacting an aqueous silver nitrate solution with an aqueous halide salt solution in a colloidal solution contained in a precipitation vessel comprising the steps of:

applying pressure to the aqueous silver nitrate solution in a vessel and the aqueous halide salt solution in another vessel by pressurizing each vessel with gas from pressure vessels via pressure control valves; and controlling flow rates using adjustable valves in the feed lines.

2. The method of claim 1, wherein the feed lines each have a flow resistance, and said each flow resistance is controlled by controlling each flow path opening in said feed lines, wherein adjustable valves are used in the feed lines to control flow path openings.

3. The method of claim 1, wherein the feed lines each have a flow resistance, and said applied pressure and said each flow resistance are controlled according to a value of electric potential measured with respect to a mixed solution reacting in the precipitation vessel.

4. The method of claim 2, wherein said applied pressure and said each flow-path opening are controlled according to a value of electric potential measured with respect to a mixed solution reacting in the precipitation vessel.

5. The method of claim 2 or 4, wherein said controlling flow path opening in said feed lines is made by a control valve varying a cross sectional area of flow path and an actuator to actuate said control valve which is installed in said feed lines respectively.

* * * * *